US005919740A

United States Patent [19]

Bloch et al.

[11] Patent Number: 5,919,740

[45] Date of Patent: Jul. 6, 1999

[54] ALKYLTHIOPHOSPHATE SALTS FOR LUBRICATING OILS

[75] Inventors: Ricardo A. Bloch, Scotch Plains; Alexander B. Boffa, Glen Gardner, both of N.J.

[73] Assignee: Exxon Chemical Patents Inc, Linden, N.J.

[21] Appl. No.: 09/087,541

[22] Filed: May 29, 1998

[51] Int. Cl.[6] ..... C10M 137/06

[52] U.S. Cl. ..... 508/435; 508/436; 558/208

[58] Field of Search ..... 558/208; 508/433, 508/435, 436

[56] References Cited

U.S. PATENT DOCUMENTS

| | | | |
|---|---|---|---|
| 2,579,037 | 12/1951 | Evans et al. | 252/48.6 |
| 2,932,614 | 4/1960 | Lynch et al. | 508/433 |
| 2,959,544 | 11/1960 | Smith et al. | 252/32.7 |
| 3,193,500 | 7/1965 | Hartle | 252/32.7 |
| 3,211,648 | 10/1965 | Hopkins et al. | 252/32.7 |
| 3,640,872 | 2/1972 | Wiley et al. | 252/75 |
| 3,686,243 | 8/1972 | Rigdon et al. | 260/429.9 |
| 3,720,613 | 3/1973 | Brown et al. | 252/32.7 E |
| 4,244,827 | 1/1981 | Michaelis et al. | 508/435 |
| 4,259,192 | 3/1981 | Lilburn | 508/433 |
| 4,400,283 | 8/1983 | Horodysky et al. | 508/433 |
| 4,410,434 | 10/1983 | Andress et al. | 252/32.7 R |
| 4,450,096 | 5/1984 | Horodysky et al. | 508/435 |
| 4,460,511 | 7/1984 | Boston | 558/208 |
| 4,778,906 | 10/1988 | Love et al. | 556/25 |

*Primary Examiner*—Jacqueline V. Howard
*Attorney, Agent, or Firm*—John J. Mahon

[57] ABSTRACT

There are disclosed antioxidant additives for lubricating oils which exhibit reduced phosphorus volatility, the additives being sodium, potassium, lithium or oil soluble amine salts of a dialkyldithiophosphoric acid prepared by reacting $P_2S_5$ with a mixture of alcohols consisting of (a) a polyol of the formula $R(OH)_n$ where R is a $C_2$–$C_{20}$ hydrocarbyl group and n is 2–10 and (b) an aliphatic monohydric alcohol having 3–18 carbon atoms, the mixture containing relative amounts of polyol and monohydric alcohol such that 50 mole % of the total OH groups are OH groups of the polyol.

8 Claims, No Drawings

ALKYLTHIOPHOSPHATE SALTS FOR LUBRICATING OILS

This invention relates to improved salts of dialkyldithiophosphoric acid which are useful as antioxidants in lubricating oils. More particularly, this invention relates to such salts which exhibit reduced volatility of phosphorus when subjected to the high temperature environments of engine operating conditions.

Dialkyldithiophosphoric acid salts are particularly useful as antioxidants in lubricating oils. Such compounds are generally prepared by reacting alcohols with phosphorus pentasulfide ($P_2S_5$) and thereafter neutralizing the resulting acid with a metal, zinc being the traditional metal used to produce the additive salt. It is highly desirable to produce such salts which exhibit low volatility of phosphorus since phosphorus is known to contaminate the catalyst in the catalytic muffler which treats the automobile exhaust. It is the object of the present invention to provide such antioxidant salts which exhibit reduced phosphorus volatility.

Love et al. In U.S. Pat. No. 4,778,906 discloses zinc salts of dialkyldithiophosphoric acids resulting from mixtures of aliphatic monohydric alcohols and polyols, but zinc salts tend to form unusable gels when high proportions of polyols, i.e., more than about 30 mole % are used in mixtures with monoalcohols to make the dialkyldithiophosphoric acid. Colclough in U.S. Pat. No. 5,013,465 discloses metal dithiophosphates resulting from a mixture of alcohols and diols, the metal salts being zinc, molybdenum and copper. Lilburn et al. In U.S. Pat. No. 4,259,192 disclose oil soluble dithiophosphate esters based on poly(oxyalkylene) alcohols as additives for lubricating oil compositions. Wiley et al. in U.S. Pat. No. 3,944,495 disclose metal salts where the dithiophosphate has been prepared from alcohols containing an ether or sulfur linkage. Goldsmith in U.S. Pat. No. 3,029,268 discloses phosphorodithioic acids prepared from alcohols where the aliphatic groups can contain inert substituents such as ether, ester, nitro, sulfide and the like. Horodysky in U.S. Pat. No. 4,450,096 discloses products formed by reacting $P_2S_5$ with hydrocarbyl diols having 12–20 carbon atoms then reacting this product with a metal oxide or a metal salt.

In accordance with the present invention there has been discovered an antioxidant additive for lubricating oils which exhibits reduced phosphorus volatility, the additive being a sodium, potassium, lithium or oil soluble amine salt of a dialkyldithiophosphoric acid prepared by reacting $P_2S_5$ with a mixture of alcohols consisting of (a) a polyol of the formula $R(OH)_n$ where R is a $C_2$–$C_{20}$ hydrocarbyl group and n is 2–10 and (b) an aliphatic monohydric alcohol having 3–18 carbon atoms, the mixture containing relative amounts of polyol and monohydric alcohol such that 50–75 mole % of the total moles of OH groups in the mixture are the OH groups of the polyol. This invention further comprises lubricating oil compositions containing 0.1% to 6% by weight of the aforesaid antioxidant additive, preferably 0.1 to 4% by weight.

Suitable polyhydric alcohols (polyols) useful in forming the additives of the present invention are represented by the formula $R(OH)_n$ where R is an aliphatic or cycloaliphatic hydrocarbyl group and n is 2–10, preferably 2. The hydrocarbyl group may contain about 2–20 carbon atoms. Such polyols may contain about 2–10 hydroxyl groups, more preferably, 2–6 hydroxyl groups. Particularly useful polyols are hexanediol, neopentylglycol, trimethylolethane, trimethylolpropane, trimethylolbutane, pentaerythritol, dipentaerythritol, ethylene glycol and propylene glycol. 1,6-hexanediol is particularly preferred.

Suitable monohydric alcohols are those aliphatic alcohols having 3–18 carbon atoms. Particularly preferred are alkanols having 6–13 carbon atoms such as 4-methyl-2-pentanol or n-tridecanol.

A preferred mixture of alcohols will contain about 50 mole % of OH groups from a diol, such as hexanediol.

The method for preparing the dialkyl dithiophosphoric acid is well known to those skilled in the art. It typically involves heating a mixture of $P_2S_5$ in a suitable hydrocarbon solvent and adding thereto the mixture of polyol and monohydric alcohol with heating being continued until a reaction is completed whereupon the distillate is removed and the remaining mixture cooled and filtered to remove any residual $P_2S_5$ followed by recovery of the dialkyldithiophosphoric acid. Or, $P_2S_5$ may be slowly added to the mixture of polyol and monohydric alcohol.

In the next step of the formation of the additive of this invention a basic sodium, lithium or potassium salt is used in order to neutralize the product if a metal salt additive is desired. In the alternative, an oil soluble aliphatic amine is used to provide the amine salt additives of this invention.

Suitable amines for use in accordance with this invention may generally be described as oil-soluble, aliphatic primary, secondary or tertiary amines having about 4–30 carbon atoms. Such amines may also include hydroxyalkyl amines and ether amines and particularly preferred are hydroxyalkyl ether amines or alkyl primary amines containing about 14–28 carbon atoms, particularly primary hydroxy ether amines. Suitable amines include octylamine, dodecylamine, laurylamine, tridecylamine, oleylamine, cocoamine, $C_{12-C14}$ t-alkyl primary amine, octadecylamine and the like. The preferred amine is a tertiary amine of the formula $C_{18}H_{37}OC_3H_6N(C_2H_4OH)_2$.

The additives of this invention will be employed in lubricating oil compositions based on either natural or synthetic oils of lubricating viscosity and such compositions are further embodiments of this invention.

Natural oils useful as basestocks in this invention include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Alkylene oxide polymers and interpolymers and derivatives thereof where the terminal hydroxyl groups have been modified by esterification, etherification, etc., are a class of known synthetic lubricating oils useful as basestocks in this invention. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils useful in this invention comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol).

Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tertbutylphenyl) silicate, hexa-(4-methyl-2-pentoxy) disiloxane, poly(methyl) siloxanes and poly (methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improved one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The compositions of this invention are principally used in the formulation of crankcase lubricating oils for passenger car engines. The additives listed below are typically used in such amounts so as to provide their normal attendant functions. Typical amounts for individual components, including the metal or amine dialkyldithiophosphates, are also set forth below. All the values listed are stated as mass percent active ingredient in the total lubricating oil composition.

| ADDITIVE | MASS % (Broad) | MASS % (Preferred) |
|---|---|---|
| Ashless Dispersant | 0.1–20 | 1–8 |
| Metal Detergents | 0.1–15 | 0.2–9 |
| Corrosion Inhibitors | 0–5 | 0–1.5 |
| Metal or Amine Dihydrocarbyl Dithiophosphate | 0.1–6 | 0.1–4 |
| Supplemental Anti-oxidant | 0–5 | 0.01–3 |
| Pour Point Depressant | 0.01–5 | 0.01–1.5 |
| Anti-foaming Agent | 0–5 | 0.001–0.15 |
| Supplemental Anti-wear Agents | 0–5 | 0–2 |
| Friction Modifier | 0–5 | 0–1.5 |
| Viscosity Modifier | 0.01–6 | 0–4 |

The individual additives may be incorporated into a basestock in any convenient way. Thus, each of the components can be added directly to the basestock by dispersing or dissolving it in the basestock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into basestock to make finished lubricant. Use of such concentrates is conventional. The concentrate will typically be formulated to contain the additive(s) in proper amounts to provide the desired concentration (such as in the table above) in the final formulation when the concentrate is combined with a predetermined amount of base lubricant. Such concentrates will typically contain (in base oil) about 2.5–90%, preferably 15–75% and most preferably 25–60% by weight additives.

A concentrate is conveniently made by first making a pre-mix of ashless dispersant and metal detergents that is pre-blended at a temperature of about 95° C. Thereafter, the pre-mix is cooled to at least 85° C. and the additional components are added.

A further embodiment of this invention is a lubricating oil concentrate comprising the metal or amine salt of this invention present in amounts of 2.5–90% by weight, preferably 15–75%, more preferably 25–60% by weight.

The final crankcase lubricating oil formulation may employ from 2 to 20 mass % and preferably 4 to 15 mass % of the concentrate of additive package with the remainder being base stock.

Ashless dispersants maintain in suspension oil insolubles resulting from oxidation of the oil during wear or combustion. They are particularly advantageous for preventing the precipitation of sludge and the formation of varnish, particularly in gasoline engines.

Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is an $\alpha,\omega$-diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene).

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic ester, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents may be present and these function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more, such as a magnesium sulfonate of TBN 400.

Detergents that may be used include oil-soluble neutral and overbased sulfonates, phenates, sulfurized phenates, thiophosphonates, salicylates, and nephthenates and other oil-soluble carboxylates of a metal, particularly the alkali, e.g., sodium, potassium, lithium and magnesium. Preferred are neutral or overbased calcium and magnesium phenates and sulfonates.

Oxidation inhibitors or antioxidants reduce the tendency of basestocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oils soluble phenates and sulfurized phenates, phosphosulfurized or sulfurized hydrocarbons, phosphorous esters, metal thiocarbamates, oil soluble copper compound as described in U.S. Pat. No. 4,867,890, and molybdenum containing compounds.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof Derivatives of 1,3,4-thiadiazoles such as those described in U.S. Pat. Nos. 2,719,125; 2,719,126; and 3,087,932; are typical. Other similar material are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in U.K. Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil improvers, lower the minimum temperature at which the fluid will flow or can be poured. Such additives are well known. Typical of those additives which improve the low temperature fluidity of the fluid are $C_8$ and $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The invention is further illustrated by the following examples which are not to be considered as limitation of its scope. Percentages are by weight unless otherwise stated.

EXAMPLE 1

A mixture of 2 moles (316.77 grams) of 4-methyl-2-pentanol and 1 mole (183.23 grams) of 1,6-hexanediol (50 mole % of the OH groups are polyol OH groups) was reacted with 186.2 grams of $P_2S_5$ at 85° C. for about a 2 hour period in order to prepare the corresponding dialkyl dithiophosphoric acid, which had 12.15% P. The product (109 grams) was then neutralized with 188.96 grams of an amine of the formula $C_{18}H_{37}OC_3H_6N(C_2HOH)_2$ to provide the additive of the invention. The percent phosphorus in the product was 4.36%.

EXAMPLE 2

Following the procedure of Example 1 a similar product was prepared from a mixture made by reacting n-tridecanol and 1,6-hexanediol in a molar ratio of 2:1 with $P_2S_5$. Here, 50 mole % of the OH groups are from the polyol. The phosphorus content of the dialkyl dithiophosphoric acid was 8.78%. The acid was then neutralized with the same amine as used in Example 1 to provide another amine salt of this invention.

EXAMPLE 3

A base lubricating oil formulation was prepared composed of the following: 4 wt. % of an ethylene copolymer amide dispersant, 0.001% silicone anti-foam additive, 1.2% overbased magnesium sulfonate detergent additive, 0.3% hindered phenol antioxidant, 0.3% alkyldiphenylamine antioxidant, 0.2% glycerol monooleate friction modifier, 0.2% ethoxylated C18 primary amine friction modifier, 0.6% oil soluble copper antioxidant, 0.75% of a borated polyalkenylsuccinimide dispersant and 7.7% olefin copolymer viscosity modifier with the balance being mineral base oil.

To this base formulation were added 10 different phosphorus-containing antioxidant compounds, 9 of which were for comparative purposes (Oils #1–9) and the 10th formulation (Oil #10) was one made using the Example 1 additive of the invention. These oils were as follows:

| OIL | TYPE OF DDP SALT | AMOUNT IN OIL |
|---|---|---|
| #1 | A zinc dialkyldithiophosphate (ZDDP) containing 7.7% phosphorus based on a mixture of isomeric C8 alcohols and 2-butanol | 1.125% |
| #2 | A ZDDP containing 7.7% phosphorus based on 4-methylpentanol-2 | 1.125% |
| #3 | A ZDDP containing 6.7% phosphorus based on 2-ethylhexanol | 1.286% |
| #4 | A ZDDP containing 2.9% phosphorus based on nonylphenol | 3.103% |
| #5 | A ZDDP containing 2.9% phosphorus based on dodecylphenol | 3.103% |
| #6 | A ZDDP containing 7.6% phosphorus based on a mixture of isopropanol and 4-methylpentanol-2 | 1.139% |
| #7 | A ZDDP containing 7.7% phosphorus based on a mixture of 2-methylpentanol, 1-pentanol and 2-methylbutanol | 1.125% |
| #8 | A ZDDP containing 6.7% phosphorus based on a mixture of isomeric C8 alcohols and primary C8 alcohols | 1.286% |
| #9 | A ZDDP containing 6.9% phosphorus based on 2-ethylhexanol | 1.216% |
| #10 | The additive amine salt of Example 1 | 2.064% |

Note: The amounts of other additives in the formulations was kept at the same percentage level, the amount of base mineral oil was changed to reflect the difference in phosphorus additive content. All percentages are by weight.

The phosphorus volatility of these 10 oils was then measured according to the Selby-Noack Volatility Test which is published in SAE Paper 961227: "A New Approach to the Noack Volatility Test", January, 1994 by Selby et al. This tests the amount of volatile phosphorus as determined by elemental analysis of the volatilized oil that is collected from the test. The results are shown in Table 1. The results clearly indicate the advantage in use of the additive of the invention (Oil #10) in reducing the amount of volatile phosphorus.

TABLE 1

RESULTS OF PHOSPHORUS LOSS IN SELBY-NOACK VOLATILITY TEST

| Oil | wt. % of oil loss NOACK | Volatile Loss, % P |
|---|---|---|
| #1 | 21.03 | 0.6076508 |
| #2 | 24 | 0.4545455 |
| #3 | 22.85 | 2.2875703 |
| #4 | 22.24 | 0.2993271 |
| #5 | 20.78 | 0.2352453 |
| #6 | 23.52 | 0.818087 |
| #7 | 21.13 | 6.5593742 |
| #8 | 23.87 | 1.4364789 |
| #9 | 22.13 | 2.10663164 |
| #10 | 22.31 | 0.1733938 |

What is claimed is:

1. An antioxidant additive for lubricating oils which exhibits reduced phosphorus volatility, the additive being a sodium, potassium, lithium or oil soluble amine salt of a dialkyldithiophosphoric acid prepared by reacting $P2S_5$ with a mixture of alcohols consisting of (a) a polyol of the formula $R(OH)_n$ where R is a $C_2$–$C_{20}$ hydrocarbyl group and n is 2–10 and (b) an aliphatic monohydric alcohol having 3–18 carbon atoms, the mixture containing relative amounts of polyol and monohydric alcohol such that 50–75 mole % of the total moles of OH groups are the OH groups of the polyol.

2. The antioxidant of claim 1 wherein the polyol is hexane diol.

3. The antioxidant of claim 1 wherein the monohydric alcohol has 6–13 carbon atoms.

4. The antioxidant of claim 1 wherein the amine is an alkyl primary amine or an ether amine having 14–28 carbon atoms.

5. The antioxidant of claim 4 wherein the amine is $C_{18}H_{37}OC_{36}N(C_2H_4OH)_2$.

6. The additive of claim 1 wherein the polyol is a diol and there are present 50 mole % of OH groups from the diol.

7. A lubricating oil composition comprising 0.1% to 6% of the antioxidant of claim 1, 2, 3, 4 or 5.

8. The composition of claim 7 wherein there is present 0.1 to 4% by weight of the antioxidant.

* * * * *

UNITED STATES PATENT AND TRADEMARK OFFICE

CERTIFICATE OF CORRECTION

PATENT NO. : 5,919,740
DATED : July 6, 1999
INVENTOR(S) : R. Bloch et al.

It is certified that error appears in the above-identified patent and that said Letters Patent is hereby corrected as shown below:

Column 8,
Line 22, delete "P2S$_5$" and insert therefore -- $P_2S_5$ --.
Line 39, delete "$C_{18}H_{37}OC_{36}N(C_2H_4OH)_2$" and insert therefore -- $C_{18}H_{37}OC_3H_6N(C_2H_4OH)_2$ --.

Signed and Sealed this

Twenty-ninth Day of October, 2002

*Attest:*

*Attesting Officer*

JAMES E. ROGAN
*Director of the United States Patent and Trademark Office*